US009108780B2

(12) United States Patent
Monti

(10) Patent No.: US 9,108,780 B2
(45) Date of Patent: Aug. 18, 2015

(54) CARDBOARD CONTAINER FOR BOTTLES AND A BLANK FOR OBTAINING THE CONTAINER

(71) Applicant: Marchesini Group S.p.A., Pianoro (Bologna) (IT)

(72) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 286 days.

(21) Appl. No.: 13/678,639

(22) Filed: Nov. 16, 2012

(65) Prior Publication Data

US 2013/0126374 A1 May 23, 2013

(30) Foreign Application Priority Data

Nov. 21, 2011 (IT) ..... BO2011A0664

(51) Int. Cl.

| | |
|---|---|
| ***B65D 71/40*** | (2006.01) |
| ***B65D 5/42*** | (2006.01) |
| ***B65D 5/50*** | (2006.01) |
| ***B65D 71/72*** | (2006.01) |

(52) U.S. Cl.

CPC *B65D 71/40* (2013.01); *B65D 5/42* (2013.01); *B65D 5/5019* (2013.01); *B65D 71/72* (2013.01)

(58) Field of Classification Search

CPC ..... B65D 71/40; B65D 5/42; B65D 5/5019
USPC ..... 206/427, 485, 486, 487, 435; 229/934, 229/121
See application file for complete search history.

(56) References Cited

U.S. PATENT DOCUMENTS

| | | | | |
|---|---|---|---|---|
| 2,919,844 | A * | 1/1960 | Anderson, Jr. | 229/120.011 |
| 3,375,934 | A * | 4/1968 | Bates | 211/72 |
| 3,390,783 | A * | 7/1968 | Quackenbush, Jr. | 211/73 |
| 3,840,171 | A * | 10/1974 | Waters | 206/562 |
| 3,949,930 | A * | 4/1976 | Giordano | 206/562 |
| 5,044,498 | A * | 9/1991 | Galiegue et al. | 206/429 |
| 5,725,109 | A | 3/1998 | Moulton et al. | |
| 6,834,762 | B2 * | 12/2004 | Krisko et al. | 206/162 |
| 7,789,231 | B2 * | 9/2010 | Requena | 206/427 |

FOREIGN PATENT DOCUMENTS

| | | |
|---|---|---|
| DE | 8616402 U1 | 9/1986 |
| DE | 4219922 A | 3/1993 |

OTHER PUBLICATIONS

European Search Report for Corresponding application No. EP12191696, completed Jan. 30, 2013, 2 pages.

* cited by examiner

*Primary Examiner* — Steven A. Reynolds
(74) *Attorney, Agent, or Firm* — Francis J. Maguire; Ware Fressola Maguire & Barber LLP

(57) ABSTRACT

The cardboard container has a base wall (10), a first lateral wall (11) and a second lateral wall (12), at two opposite longitudinal sides of the base wall (10), and which are foldable. A first series of tabs (2) each exhibit a first portion (21) exhibiting a through-hole (210) for inserting a bottle (F) and which is connected with the first lateral wall (11). A second series of tabs (3) each exhibit a first portion (31) exhibiting a through-hole (310) for insertion of a bottle (F) and which is connected in a single body with the second lateral wall (12) and with a second portion (33) fixed to the base wall (10). All the tabs are foldable, together with the first lateral wall (11) and the second lateral wall (12), such as to enable the container to take on a flattened configuration (I) and an opened-out volume (O).

19 Claims, 9 Drawing Sheets

CARDBOARD CONTAINER FOR BOTTLES AND A BLANK FOR OBTAINING THE CONTAINER

FIELD OF THE INVENTION

The present invention relates to the technical sector concerning packing of bottles, for example bottles containing pharmaceutical or cosmetic products.

DESCRIPTION OF THE PRIOR ART

In this specific technical sector a process that is usually carried out for performing the packing of the bottles includes positioning the bottles in a supporting container, and thereafter inserting the container containing the bottles internally of a relative box, for forming the final pack, possibly inserting also an informative sheet of paper.

The containers used for supporting the bottles can be for example made of a plastic material which are obtained by heat-forming in such a way as to exhibit a series of housings (A) in which the bottles (F) are positioned (an example of prior art containers made of heat-formed plastic material is illustrated in FIGS. 1 and 1A).

This type of container exhibits a structure (G) that in itself is rigid, and therefore stable and suitable for containing bottles, but which exhibits a height (H) that is invariable, a not insignificant detail in the designing of the machines for performing the packing operations automatically and/or semi-automatically.

In fact, the stores for containing the containers must perforce exhibit large dimensions in order to contain the containers stacked one on another.

Also known is the use of cardboard containers obtained starting from flat blanks which, once made using paper industry processes, are folded about relative fold lines such as to form the container which exhibits the particularity of being maintainable in a flattened configuration, with the aim of facilitating storage thereof and, at the moment of insertion into the bottles, of being openable-out.

The use of cardboard containers doubtless exhibits the advantage of being stockable in considerably smaller stores with respect to the case of plastic containers.

An example of a cardboard container (C) in the prior art, and the relative blank (CF) from which it is obtained, is illustrated in the accompanying FIGS. 2A, 2B, 2C, 2D of the drawings.

The cardboard container (C) illustrated in the figures exhibits a base wall (CB), a first lateral wall (CL1) in a single body with the base wall (CB) and a second lateral wall (CL2) which is fixed to the base wall (CB), and an upper wall (CS), in a single body with the two lateral walls (CL1; CL2), which is provided with through-holes (P) for insertion of the bottles (F).

The fact that the upper wall (CS) of the container (C) is in a single body with the two lateral walls (CL1, CL2) gives a certain "heaviness" to the container (C) as in the opened-out volume the upper wall (CS) will tend to flex and the first lateral wall (CL1) and the second lateral wall (CL2) will tend to bend towards the base wall (CB).

In this regard, the container (C) must comprise a central reinforcing wall (CR) interposed between the base wall (CB) and the upper wall (CS), for example parallel to the two lateral walls (CL1, CL2).

The two lateral walls (CL1, CL2) are foldable both with respect to the base wall (CB) and with respect to the upper wall (CS) (see FIG. 2C) in such a way as to enable the container (C) to take on a flattened configuration in which the first lateral wall (CL1) is arranged externally and on the same plane as the base wall (CB), the second lateral wall (CL2) is arranged above and in contact with the base wall (CB) and the upper wall (CS) is arranged above and in contact with the base wall (CB) and the first lateral wall (CL1), and such that it can be brought into the opened-out use configuration thereof, as a container for the bottles (illustrated in FIG. 2A and in FIG. 2D).

The central reinforcing wall (CR) is provided with an upper flap (CR1) fixed to the lower surface of the upper wall (CS) and a lower flap (CR2) fixed to the upper base surface (CB): the central reinforcing wall (CR) is foldable with respect to the two flaps (CR1, CR2), and therefore with respect to the upper wall (CS) and the lower wall (CB), in such a way as to fold between them when the container is in the flattened configuration (see FIG. 2C).

The cardboard blank (CF), from which the above-described container (C) is obtained (from right to left in FIG. 2B): a first main portion (CB), which will constitute the base wall (CB) of the container (C), a first secondary portion (CL1), which will constitute a lateral wall (CL1) of the container (C), connected in a single body to a longitudinal side of the first main portion (CB), a second main portion (CS), which will constitute the upper wall (CS) of the container (C) which is provided with through-holes (P) of adequate dimensions for receiving the bottles (F) and which is connected in a single body with a longitudinal side of the first secondary portion (CL1), a second secondary portion (CL2), which will constitute a lateral wall (CL2) of the container (C), connected in a single body with a longitudinal side of the second main portion (CS), and a third secondary portion (CR1, CR, CR2), which will constitute the central reinforcing wall (CR) with the relative connecting flaps (CR1, CR2) at the upper wall and the lower wall of the container, connected in a single body with a longitudinal side of the second secondary portion (CL2).

In order to assemble the blank (CF) into the above-described container (C), between the first main portion (CB) and the first secondary portion (CL1) a first score line (D1) is present to facilitate the folding of the first secondary portion CL1) (lateral wall) with respect to the first main portion (CB) (base wall).

In the same way, the blank (CF) exhibits a second score line (D2) between the first secondary portion (CL1) (which will constitute a lateral wall) and the second main portion (CS) (which will constitute the upper wall), a third score line (D3) between the second main portion (CS) and the second secondary portion (CL2) (which will constitute a lateral wall); these score lines are present to enable the folding of the two lateral walls with respect to the upper wall.

Lastly, the blank (CF) also exhibits a fourth score line (D4) between the second secondary portion (CL2) and the third secondary portion CR1, CR, CR2), while the third secondary portion (CR1, CR, CR2) is in turn interested by a fifth score line (D5) and by a sixth score line (D6) which sub-divide it into a central zone (CR), which will constitute the reinforcing wall (CR) and two lateral zones, internal (CR2) and external (CR1), which will constitute the reinforcing wall (CR) and two lateral zones, internal (CR2) and external (CR1), which will constitute the two connecting flaps (CR2, CR1) respective with the lower wall (CB) and the upper wall (CS) of the container (C) (see FIG. 2B, in which the blank (CF) is illustrated and FIG. 2A which illustrates the container (C) obtained by the folding of the various portions of the blank (CF) about the various score lines described above).

The more external zone (CR1) of the third secondary portion is the one which, when the blank is folded about the various score lines, will be glued to the lower part of the upper wall (CS) while the more internal zone (CR2) is the one which will be glued to the upper part of the base wall (CB).

The fact that the upper wall (CS) of the container is in a single body with the lateral walls (CL1, CL2) (i.e. the second main portion (CS) of the blank (CS) is in a single body with the first auxiliary portion (CL1) and the second auxiliary portion (CL2)), apart from the above-cited drawback, also forces the wall to be realized with dimensions that are such that the through-holes (P) are not too close to one another, nor too close to the lateral walls, which would weaken the container in the opened-out configuration.

In fact, the dimensions of the upper wall (CS) (i.e. the second main portion of the blank) and, therefore consequently, also the dimensions of the base wall (CB) (first main portion of the blank) are designed in such a way that there is a certain space (S1) both between holes (P) and holes (P) and also a certain space (S2) both between the holes (P) and the lateral walls, such as to prevent undesired flexions and/or foldings of the parts of the upper wall (CS) about the holes when the bottles are inserted.

This, however, has the consequence of increasing the transversal dimension (S) of the containers (C), with respect to the transversal dimension (H1) of the plastic containers (see FIG. 1A and FIG. 2D). Consequently, and disadvantageously, there is the need to change the dimensions of the boxes in the case that the bottles are to be packed using the cardboard support container instead of a plastic container. Further, the cardboard container (C), once opened out, is not able to autonomously maintain the opened-out configuration, firstly, due to the poor intrinsic rigidity of the cardboard, and especially, secondly, due to the fact that the upper wall (CS) is in a single body with the lateral wall (CL1, CL2).

In fact, the upper wall (CS) exhibits dimensions that are considerably greater than those of the lateral walls and with its weight it tends to flex the walls, and bend them with respect to the base wall, notwithstanding the presence of the reinforcing wall (CR).

Therefore, as a consequence, special contingencies have to be included in the packing machine such as to maintain the opened-out volume, for example pushing against the lateral wall in an opposite direction to the folding direction of the score lines, or by providing walls in which the container is to be positioned, during the inserting operations of the bottles (see FIG. 2D in this regard).

SUMMARY OF THE INVENTION

The aim of the present invention is therefore to provide a new cardboard container for bottles, and a new blank usable for obtaining the container following the folding thereof, which can obviate the drawbacks present in the prior art, both those due to the use of heat-formed plastic material and those given by the use of cardboard containers obtained by relative blanks such as the ones described above.

A particular aim of the present invention is to provide a new cardboard container for bottles which can assume a flattened configuration, and which, once opened out such as to receive the bottles, exhibits a relatively modest transversal dimension, for example smaller than that of the prior-art cardboard containers and comparable to that of plastic containers, and which is also able to autonomously maintain the container in the opened-out configuration.

The aims are entirely obtained according to the present invention, as will be discussed further below. Other special characteristics of the cardboard container proposed with the present invention are also described below.

A further aim of the invention is to provide a new blank, which enable obtaining, once folded, the cardboard container of the invention.

BRIEF DESCRIPTION OF THE DRAWINGS

The characteristics of the invention will clearly emerge from the following description of preferred embodiments of a cardboard container for bottles and a blank from which the container is obtained, carried out with reference to the accompanying tables of drawings, in which:

FIG. 1, cited herein above, illustrates a container for bottles made of plastic material used in the prior art, while

FIG. 5A is a perspective view of the cardboard container of FIG. 3 in the flattened configuration while

FIG. 6 illustrates a partial view from above of the container of FIG. 3 while

DESCRIPTION OF THE PREFERRED EMBODIMENTS

Figure 1A:
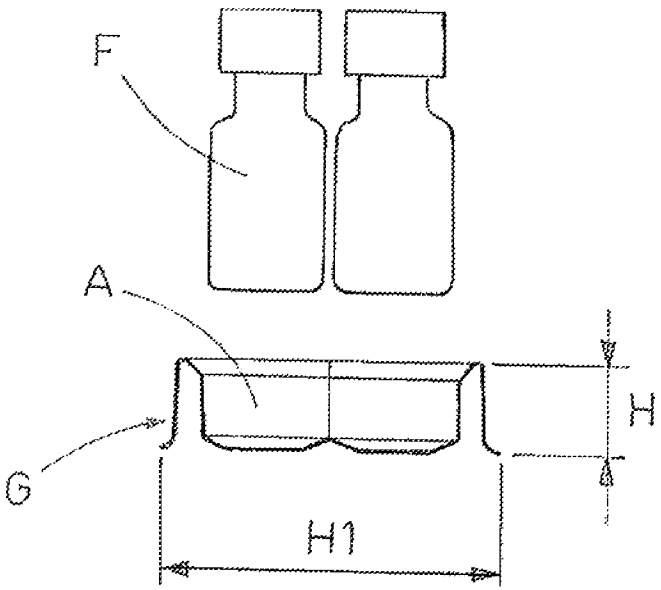
FIG. 1A PRIOR ART
FIG. 1A shows the view along section I-I of FIG. 1.
Figure 1:
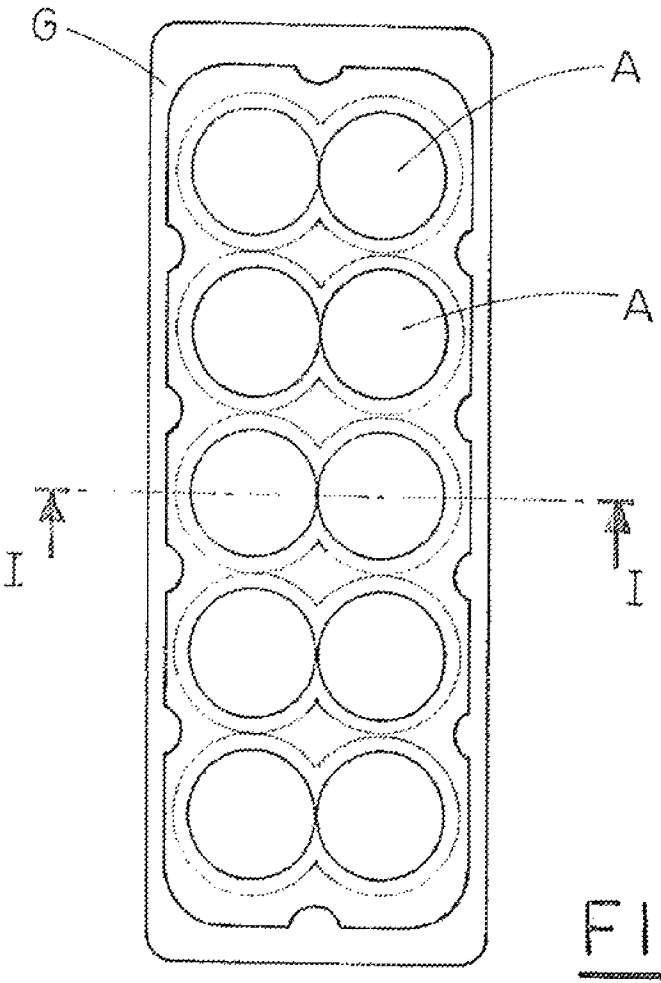
FIG. 1 PRIOR ART
Figure 2D:
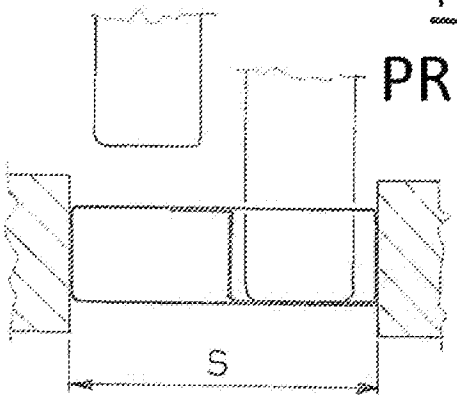
FIG. 2D PRIOR ART
FIG. 2D illustrates a second section view of the prior-art container shown in FIG. 2A, during a step of insertion of the bottles.
Figure 2A:
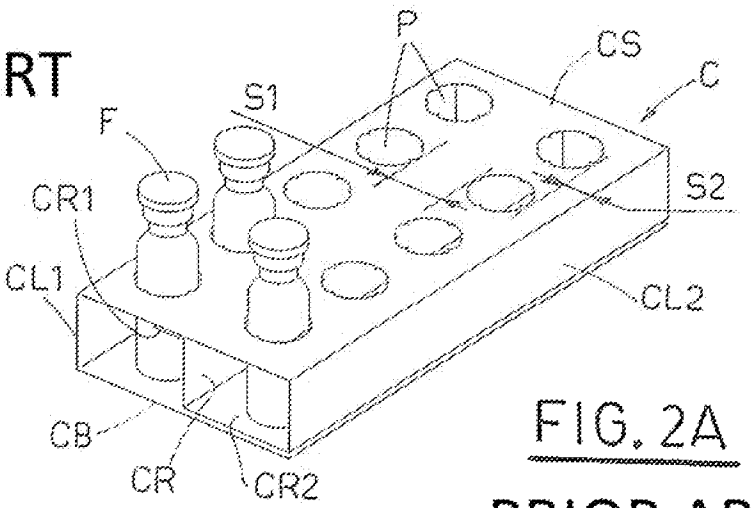
FIG. 2A PRIOR ART
FIG. 2A, cited herein above, illustrates a cardboard container for bottles according to prior art, while FIG. 2B, also cited herein above, illustrates the blank from which the container of FIG. 2A is obtainable by folding.
Figure 2B:
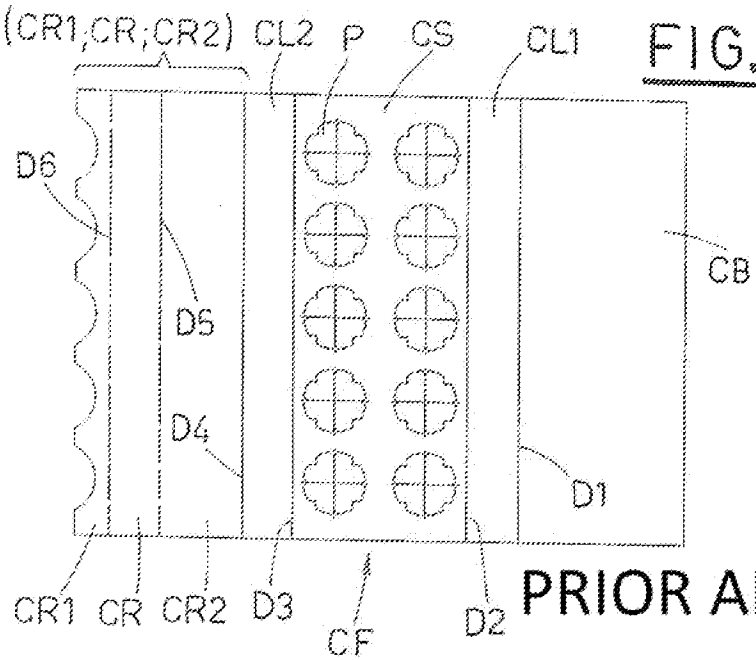
FIG. 2B PRIOR ART
FIG. 2C illustrates a passage step of the prior-art container of FIG. 2A from the flattened configuration to the opened-out configuration.
Figure 2C:
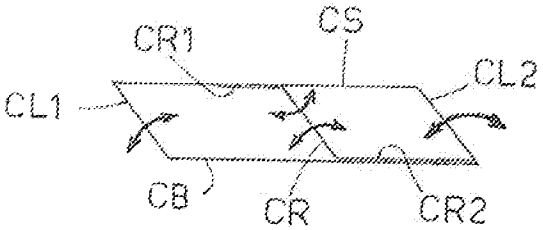
FIG. 2C PRIOR ART

With reference to the figures of the drawings, (100) denotes the cardboard container for bottles, the object of the present invention, while (F100) denotes the blank from which, following an appropriate bending, the container (100) can be obtained.

The container (100) comprises a base wall (10), a first lateral wall (11) and a second lateral wall (12), in a single body with the base wall (10) at two opposite longitudinal sides of the base wall (10), the first lateral wall (11) and the second lateral wall (12) both being foldable with respect to the base wall (10).

The container (100) further comprises a first series of tabs (2), each tab (2) exhibiting a first portion (21) and a second portion (23). The first portion (21) exhibits a through-hole (210) having dimensions such as to enable inserting a bottle (F) and is connected in a single body with the first lateral wall (11), at the opposite side to the side with which the first lateral wall (11) is in a single body with the base wall (10), while the second portion (23) is fixed to the base wall (10), for example by an adhesive.

The container (100) further comprises a second series of tabs (3) each tab (3) exhibiting a first portion (31) and a second portion (33), with the first portion (31) exhibiting a through-hole (310) having dimensions such as to enable inserting a bottle (F) and which is connected in a single body with the second lateral wall (12), at the opposite side to the side with which the second lateral wall (12) is in a single body with the base wall (10), while the second portion (33) is fixed to the base wall (10), for example by an adhesive.

A first peculiarity of the container (100) of the invention consists in the fact that the first lateral wall (11) and the second lateral wall (12) are foldable with respect to the base wall (10) in such a way as to reciprocally distance one from the other up to being arranged on a plane containing the base wall (10), externally of the two opposite longitudinal sides of the base wall (10), and the tabs (2) of the first series of tabs (2) and the tabs (3) of the second series of tabs (3), when the first lateral wall (11) and the second lateral wall (12) are folded with respect to the base wall (10) in such a way as to reciprocally distance from one another up to being arranged on a plane containing the base wall (10), externally of the two opposite longitudinal sides of the base wall (10), are contemporaneously bendable both with respect to the base wall (10) and, respectively, with respect to the first lateral wall (11) and the second lateral wall (12).

Figure 5B:
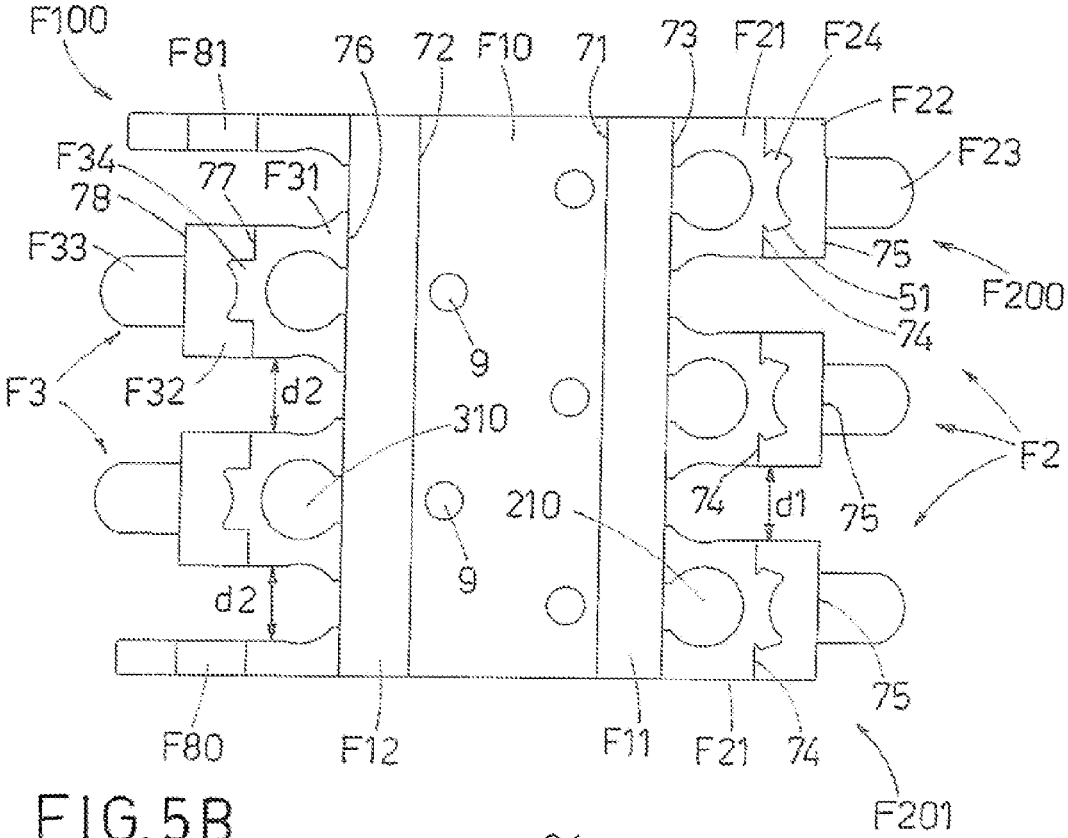
FIG. 5B is a plan view of the blank of the invention, according to a first embodiment, from which the container of FIGS. 3-5A is obtainable after folding.
Figure 5A:
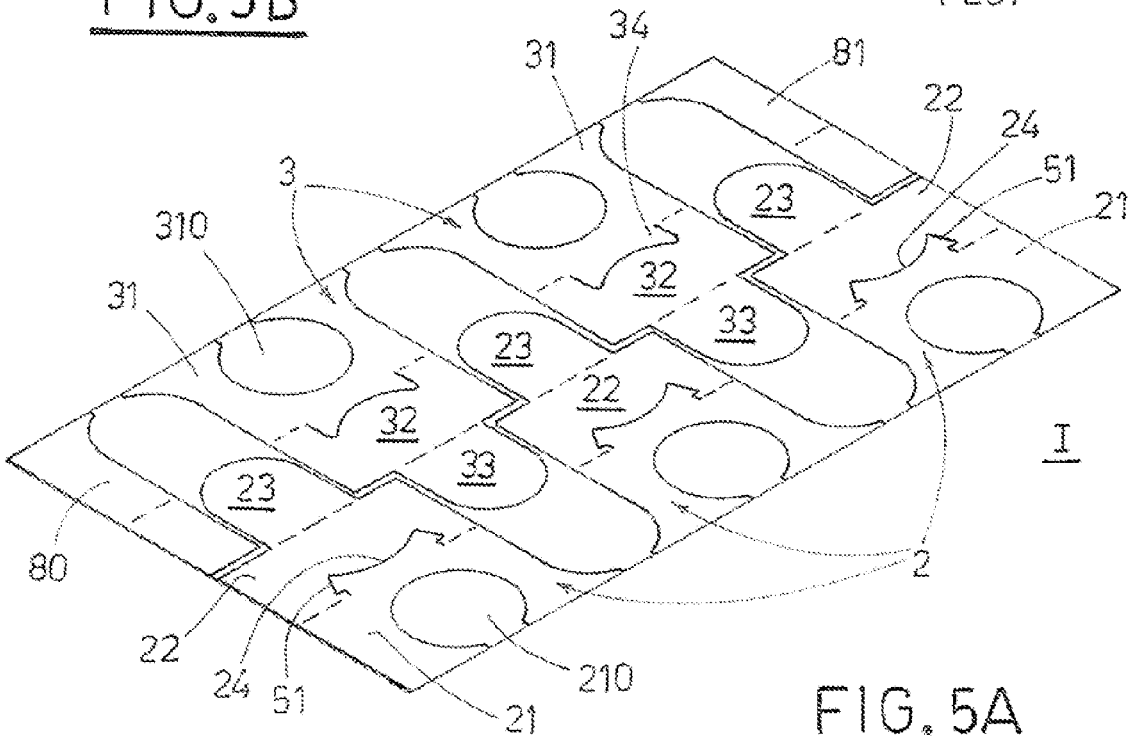

In particular the tabs (2) of the first series of tabs (2) are bendable such as to be able to take on a flat configuration above the base wall (10) and the first lateral wall (11) and the tabs (3) of the second series of tabs (3) are also foldable in such a way that they can take on a flat configuration above the base wall (10) and the second lateral wall (12) in such a way that the container (100) takes on a flattened configuration (I) (see FIG. 5A which illustrates the container in a flattened configuration (I)).

A second peculiarity of the container (100) consists in the fact that the first lateral wall (11) and the second lateral wall (12) are further foldable with respect to the base wall (10) in such a way as to be able to be arranged opposite one another and in such a way as to form an angle with respect to the base wall (10), and the tabs (2) of the first series of tabs (2) and the tabs (3) of the second series of tabs (3), when the first lateral wall (11) and the second lateral wall (12) are folded with respect to the base wall (10) in such a way as to be arranged opposite and at an angle with respect to the base wall (10), are further contemporaneously respectively bendable in such a way as to take on a corner-folded shape.

Figure 3:
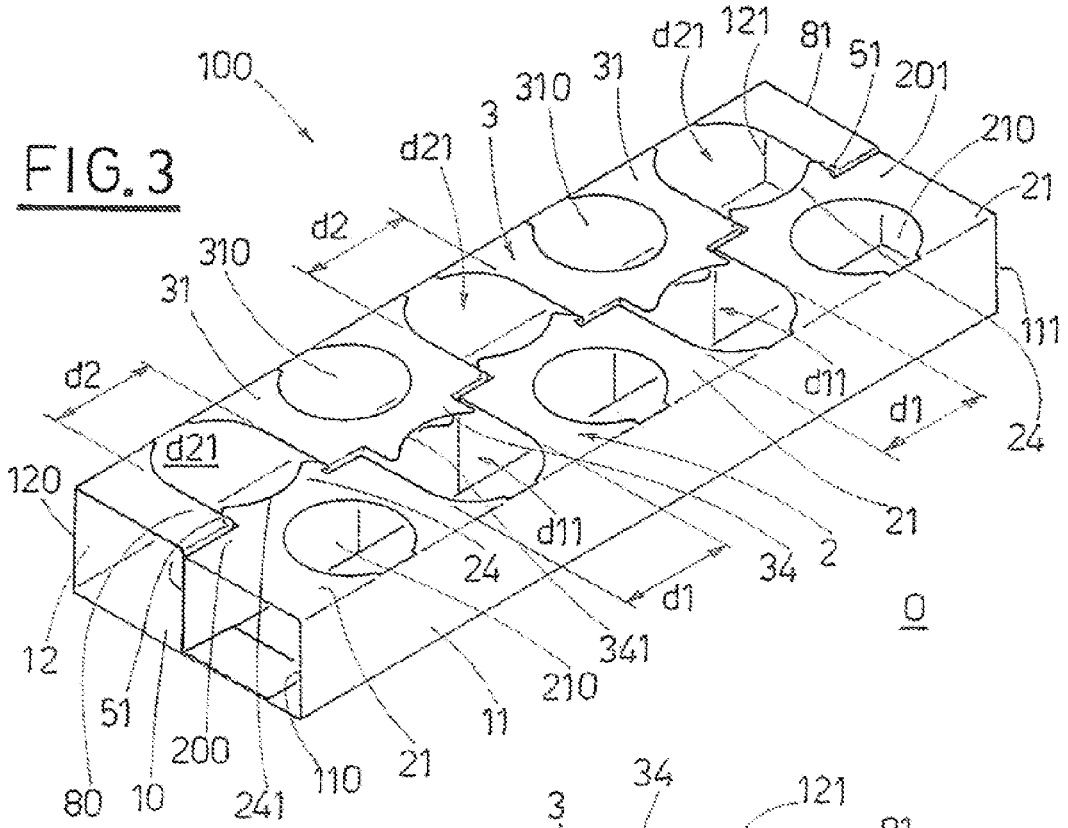
FIG. 3 illustrates a perspective view of the cardboard container for bottles, object of the invention, according to a first embodiment, in the opened-out configuration thereof, ready to receive bottles.
Figure 4:
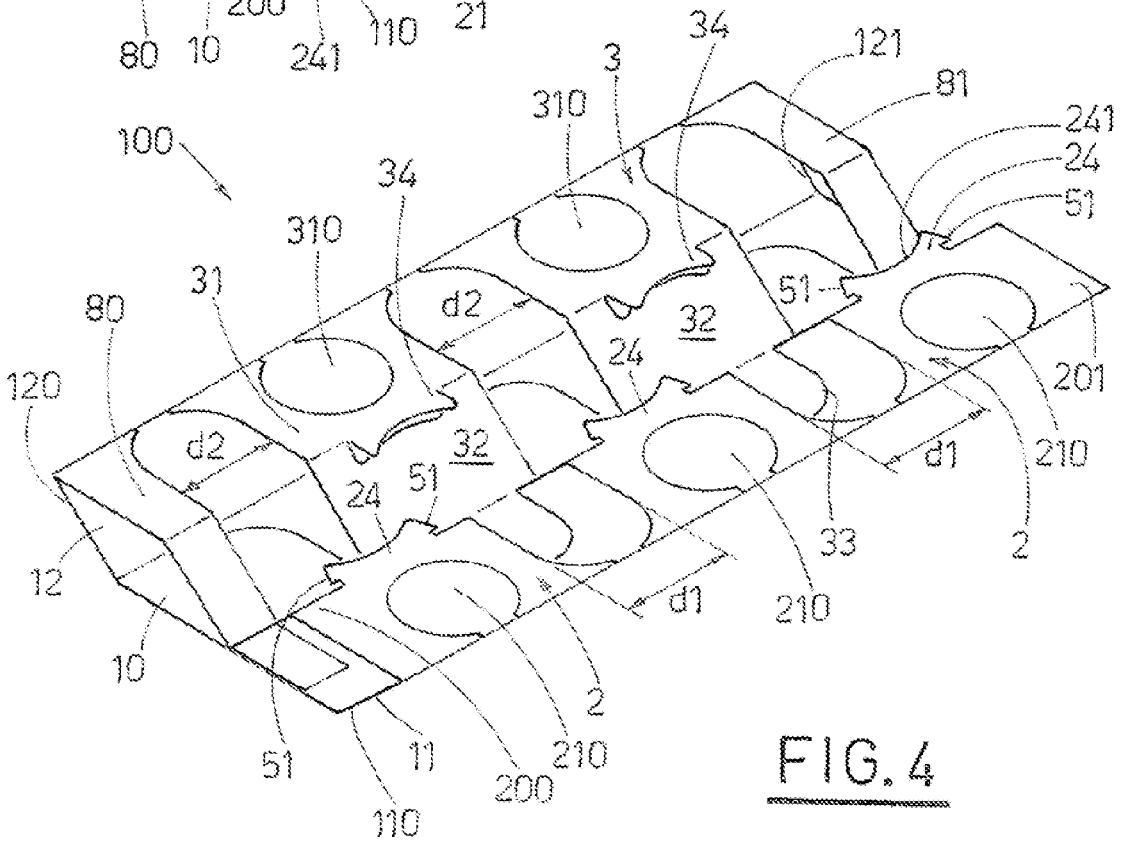
FIG. 4 illustrates a perspective view of the cardboard container according to FIG. 3 in a transition step from the flattened configuration to the opened-out configuration.

In particular, the tabs (2) of the first series of tabs (2) are bendable in such a way that the first portion (21) which is intersected by the through-hole (210) is arranged in an opposite position to the base wall (10) and the tabs (3) of the second series of tabs (3) are bendable such that the first portion (31) (which is intersected by the through-hole (310)) is also arranged opposite the base wall (10), in such a way that the container (100) takes on an opened-out configuration (O) (see FIG. 3 which illustrates the opened-out configuration (O) of the container (100) and FIG. 4 which instead illustrates a transition and passage step of the container (100) from the flattened configuration (I) to the opened-out configuration (O)).

Lastly, the container (100) further exhibits the peculiarity of being provided with stabilizing means (51; 52, 53; 54; 55, 56, 57) usable for maintaining the first series of tabs (2) and the second series of tabs (3) corner-folded, with the first portion (21), provided with the through-hole (210), of the first series of tabs (2) and with the first portion (31), provided with the through-hole (310), of the second series of tabs (3), opposite the base wall (10) such that the container maintains the opened-out configuration (O) in order to receive the bottles (F) in said through-holes (210, 310), without having recourse to the help or use of external means.

The container (100) of the invention, differently from cardboard containers of the known type, does not include a common upper wall, in a single body, between the two lateral walls, but rather includes the first series of tabs (2) which on one side are in a single body with the first lateral wall and on the other side are connected to the base wall, and the second series of tabs (3) which, on a side, are in a single body with the first lateral wall and on the other side are connected to the base wall.

This means that the first lateral wall and the second lateral wall bear a lower weight with respect to the case of containers in the prior art, and thus are also subjected to smaller flexion stresses when they are arranged folded with respect to the base wall (10) such as to be arrangeable oppositely such as to form an angle with respect to the base wall (10), i.e. when the container (100) is in the opened-out configuration (O).

Further, the fact that each tab (2) of the first series of tabs (2) and each tab (3) of the second series of tabs (3) is, independently of one another, fixed at the base wall (10), means that when the tabs are folded at an angle (i.e. when the first lateral wall (11) and the second lateral wall (12) are folded with respect to the base wall (10) such as to be arranged opposite and to form an angle therewith in order to bring the container into the opened-out configuration (O)), each single tab is subjected only to its own weight and thus intrinsically exhibits, by itself, a certain stability.

This enables designing the dimensions of the tabs and base wall in such a way that the through-holes (210), present in the first portions (21) of the tabs (2) of the first series of tabs (2), and the through-holes (310), present in the first portion (31) of the tabs (3) of the second series of tabs (3), can be realized as far as possible close to the first lateral wall (11) and the second lateral wall (12) (see for example FIG. 3 and FIG. 4).

Consequently, the container (100) provided by the present invention, beyond being able to take on a flat configuration (I), and thus having an irrelevant size in height which facilitates the storage operations thereof in relative stores, when placed in the opened-out configuration (O) exhibits a modest transversal size, comparable to the transversal size of the containers realized in heat-formed plastic material, and thus smaller than cardboard container at present used in the prior art and cited herein above.

Lastly, the container (100) proposed by the present invention does not require recourse to or readying of special specifications in the packing machines in order to maintain it in the opened-out configuration (O), during the operations of inserting the bottles (F), thanks to the presence of stabilizing means (51, 52, 53, 54, 55, 56, 57) specially provided to maintain the first series of tabs (2) and the second series of tabs (3) corner-folded, i.e. maintaining the first portion (21), provided with the through-hole (210), of the first series of tabs (2) and maintaining the first portion (31), provided with the through-hole (310), of the second series of tabs (3) opposite the base wall (10).

The above aspects constitute the main and essential aspects of the conformation of the container of the invention, common and present in the various embodiments illustrated in the various appended figures.

Other characteristics which relate to all the various embodiments illustrated in the accompanying figures of the drawing are the following. The tabs (2) of the first series of tabs (2) are connected, with the relative first portions (21), in a single body with the first lateral wall (11) in such a way that the first portions (21) are distanced from one another such that there is a space (d1) between them having dimensions that are at least the same as the transversal dimensions of a bottle (F).

In the same way, the tabs (3) of the second series of tabs (3) are connected, with the relative first portions (31), in a single body with the second lateral wall (12) in such a way that the first portions (31) are distanced from one another in such a way that between them there is a space (d2), of dimensions that are at least equal to the transversal dimensions of a bottle (F), and such as to be in a staggered position with respect to the first portions (21) of the first series of tabs (2).

This enables, with the container (100) in the opened-out configuration and the first portions (21) of the first series of tabs (2) and with the first portions (31) of the second series of tabs (3) that are opposite the base wall (10), the first portions (21) of the first series of tabs (2) to be in front of the space (d2) present between the second portions (31) of the second series of tabs (3) in such a way as to delimit seatings (d21) for inserting bottles (F), and the first portions (31) of the second series of tabs (3) are in front of the space (d1) present between the first portions of the first series of tabs (2) such as to delimit seatings (d11) for inserting the bottles (F).

Figure 6:
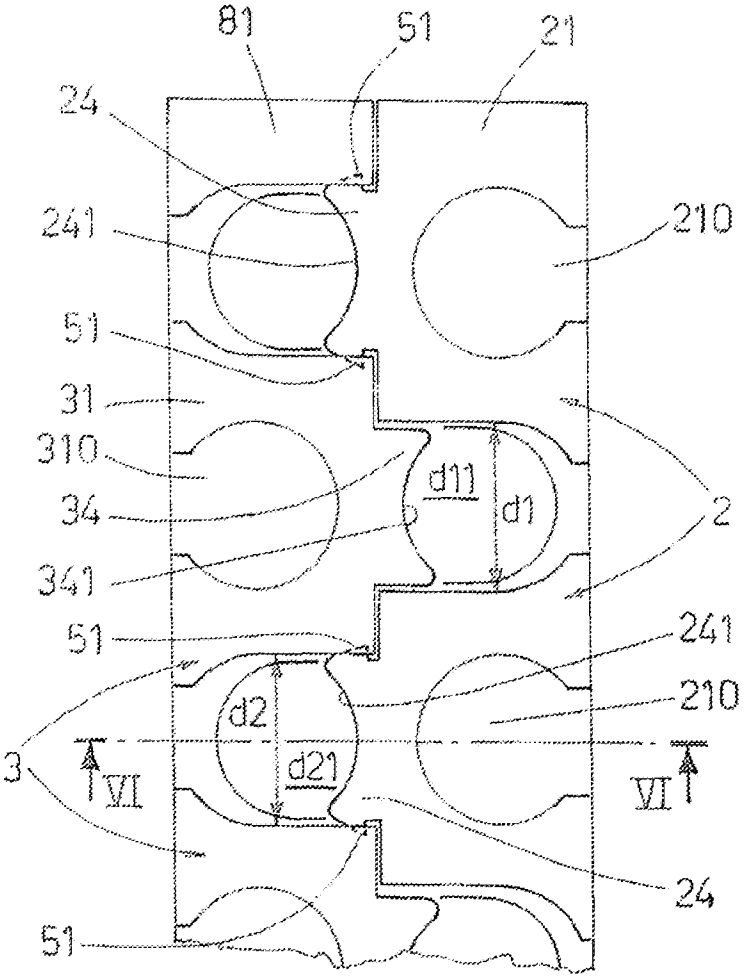

Thus, the bottles (F) can be inserted and received equally in the holes (210) present in the first portion (21) of the first series of tabs (2), in the holes (310) present in the first portion (31) of the second series of tabs (3), and in the seatings (d21) and in the seatings (d11) (see for example FIG. 3 and FIG. 6).

Each tab (2) of the first series of tabs (2) comprises a central portion (22) between the first portion (21) connected in a single body to the first lateral wall (11) and the second portion (23) fixed to the base wall (10), which is foldable both with respect to the first portion (21) and the second portion (23) and exhibits dimensions such that, with the container (100) in the opened-out configuration (O), the central portion (22) is arranged in a corner with respect to the base wall (10) and facing a respective seating of the seatings (d21), between the first portions (31) of the second series of tabs (3), such as to constitute a lateral containing wall for the bottle (F).

Correspondingly, each tab (3) of the second series of tabs (3) comprises a central portion (32), between the first portion (31) connected in a single body to the second lateral wall (12) and the second portion (33) fixed to the base wall (10), which is foldable both with respect to the first portion (31) and the second portion (33) and exhibits dimensions that are such that, with the container (100) in the opened-out configuration (O), the central portion (32) is arranged in a corner with respect to the base wall (10) and facing a seating of the seatings (d11), between the first portions (21) of the first series of tabs (2), such as to constitute a lateral containing wall for the bottle (F).

In particular, the central portions (22) of the first series of tabs (2) and the central portions (32) of the second series of tabs (3) exhibiting respective transversal dimensions that are such that, with the container (100) in the opened-out configuration (O), they are reciprocally arranged partially opposite and facing with a part of surface thereof.

Figure 7:
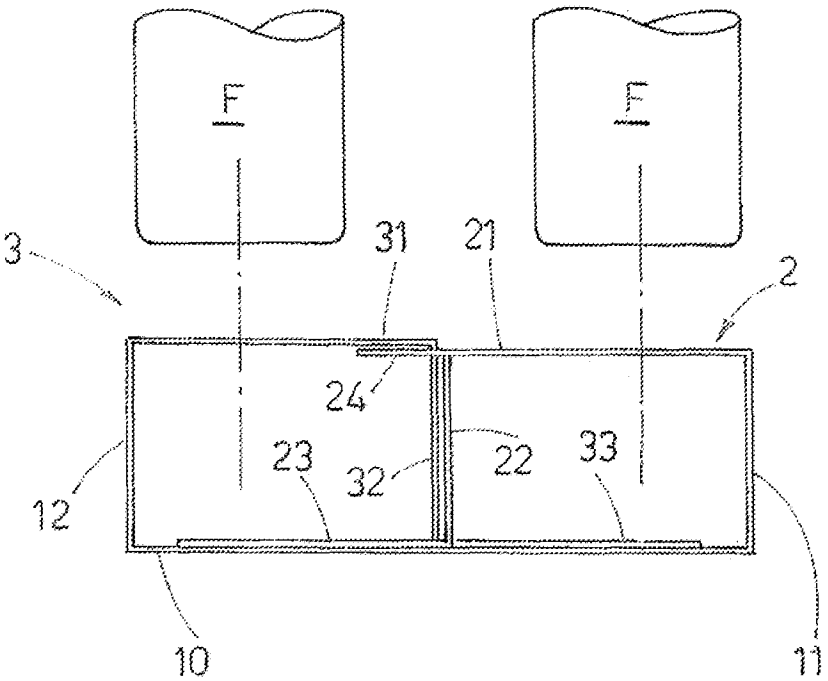
FIG. 7 shows the view according to section VI-VI of FIG. 6 in an insertion step of the bottles.

As for example illustrated in FIG. 6 and FIG. 7, the central portions (22) of the first series of tabs (2) and the central portions (32) of the second series of tabs (3) preferably exhibit respective transversal dimensions such that, with the container in the opened-out configuration (O), they are reciprocally arranged partially opposite and facing one another, and in contact with one another, with a part of the surface thereof: this lends greater sturdiness and rigidity to the container (100) when placed in the opened-out configuration (O).

In order for the bottles (F), when inserted into the container (100), to be maintained in a stable position, each of the tabs (2) of the first series of tabs (2) exhibits, between the relative first portion (21) and central portion (22), an appendage (24) which, with the container (100) in the opened-out configuration (O), projects from the central portion (22) in such a way as to interest a seating of the seatings (d21), between the first portions (31) of the second series of tabs (3), and which exhibits an arched profile (241) having a shape corresponding to the profile of a part of a bottle (F), in such a way as to constitute an abutment for the bottle (F) (see for example FIG. 6).

Correspondingly, each of the tabs (3) of the second series of tabs (3) exhibits, between the relative first portion (31) and central portion (32), an appendage (34) which, with the container (100) in the opened-out configuration (O), projects from the central portion (32), in such a way as to interest a seating of the seatings (d11), between the first portions (21) of the first series of tabs (2), and which exhibits an arched profile (341) having a shape corresponding to the profile of a part of a bottle (F), in such a way as to constitute an abutment for the bottle (F).

According to the preferred embodiments of the container (100) illustrated in the accompanying figures, the tabs (2) of the first series of tabs (2) are arranged such that a first tab (200) of the first series of tabs (2) is situated contiguous to a transversal edge (110) of the first lateral wall (11) and a final tab (201) of the first series of tabs (2) is situated contiguous to the other transversal edge (111) of the first lateral wall (11).

In this case, the tabs (3) of the second series of tabs (3) which as mentioned above are staggered with respect to the tabs (2) of the first series of tabs (2), are arranged such as to be comprised between the first tab (200) and the final tab (201) thereof (see for example FIGS. 4 and 5).

Further, still in reference to the same case, the container comprises (100) a first reinforcing tab (80) and a second reinforcing tab (81) in a single body with the second lateral wall (12) at the opposite side with which the second lateral wall (12) is in a single body with the base wall (10), and fixed to the base wall (10).

The first reinforcing tab (80) is situated contiguous with a transversal edge (120) of the second lateral wall (12) while the second reinforcing tab (81) is situated contiguous to the other transversal edge (121) of the second lateral wall (21), such that the tabs (3) of the second series of tabs (3) are comprised between the first reinforcing tab (80) and the second reinforcing tab (81).

The first reinforcing tab (80) and the second reinforcing tab (81) are bendable with respect to the base wall (10) and with respect to the second lateral wall (12) in such a way as to be arranged, with the container (100) in the flattened configuration (I), in a flat configuration above the base wall (10) and the second lateral wall (12), and such as to be arranged with a corner-configuration, with the container (100) in the opened-out configuration (O) (see FIG. 3).

Further, the first reinforcing tab (80) is positioned in such a way, and exhibits such dimensions that, between it and a first tab of the second series of tabs (3) there is a space (d2) having dimensions that correspond to the space (d2) between the tabs (3) such that, with the container in the opened-out configuration (O), between the first reinforcing tab (80) and the first tab of the second series of tabs (3) a seating (d21) is defined for insertion of a bottle (F).

Correspondingly, the second reinforcing tab (81) is positioned such that, and exhibits dimensions such that, between it and a last tab of the second series of tabs (3) there is a space (d2) of dimensions corresponding to the space (d2) between the tabs (3) such that, with the container in the opened-out configuration (O), between the second reinforcing tab (81) and the last tab of the second series of tabs (3) a seating (d21) is defined for inserting a bottle (F).

In an embodiment (not illustrated directly in the accompanying figures), the stabilizing means (51; 52, 53; 54; 55, 56, 57) are constituted by prongs associated to the first series of tabs (2), in a position such as, and of a shape and dimensions such as, with the container in the opened-out configuration (O) and with the first series of tabs (2) and the second series of tabs (3) corner-folded, to abut and hook with the edges of the central portion (32) of the second series of tabs (3) such as to maintain the container (100) in the opened-out configuration (O).

The prongs can possibly also be associated to the second series of tabs (3) in a position such as, and of a shape and dimensions such as, with the container (100) in the opened-out configuration (O) and with the first series of tabs (2) and with the second series of tabs (3) corner-folded, to abut and hook the edges of the central portion (22) of the first series of tabs (2), such as to maintain the container (100) in the opened-out configuration (O).

The prongs can possibly be associated only to the second series of tabs (3).

In the embodiment illustrated in FIGS. 3, 4, 5A, 6, 7 the stabilizing means (51, 52, 53, 54, 55, 56, 57) are constituted by prongs (51) in a single body with the appendages (24) of the first series of tabs (2) at the lateral ends of the appendages (24).

The prongs (51) are of such shape and dimensions that, with the container (100) in the opened-out configuration (O) and with the first series of tabs (2) and the second series of tabs (3) corner-folded, and with the appendages (24) of the first series of tabs (2) interesting the seating (d21) between the first portions (31) of the second series of tabs (3), to abut and hook the edges of the central portion (32) of the second series of tabs (3) such as to maintain the container (100) in the opened-out configuration (O).

In this case, with the aim of guaranteeing an optimal engagement of the prongs (51) to the edges of the central portion (32) of the second series of tabs (3), the container (100) can include that the second lateral wall (12) exhibits a slightly greater height than that of the first lateral wall (11) such that the prongs (51) present in the appendages (24) can engage the edges of the central portion (32) of the second series of tabs (3) below the folding point thereof with respect to the central portion (31) (see for example FIG. 7).

Alternatively the stabilizing means can further comprise prongs in a single body with the appendages (34) of the second series of tabs (3) at the lateral ends of the appendages (34), the prongs being of a shape and dimensions such as, with the container (100) in the opened-out configuration (O) and with the first series of tabs (2) and with the second series of tabs (3) corner-folded, and with the appendages (34) of the second series of tabs (3) which interest the seating (d11) between the first portions (11) of the first series of tabs (2), to abut and hook with the edges of the central portion (22) of the first series of tabs (2).

The stabilizing means can possibly consist of prongs present only in the appendages (34) of the second series of tabs (3).

Figure 11:
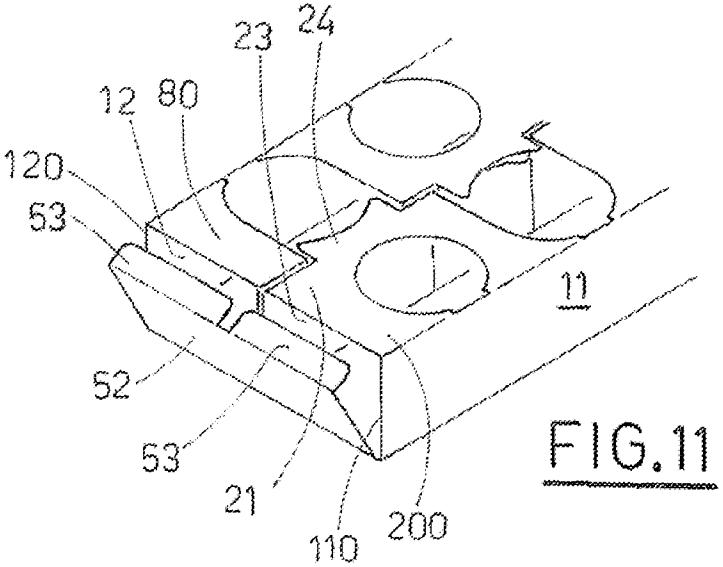
FIG. 11 illustrates, in a perspective and partial view, the container of FIG. 10 in a final step of transition to the opened-out configuration.
Figure 10:
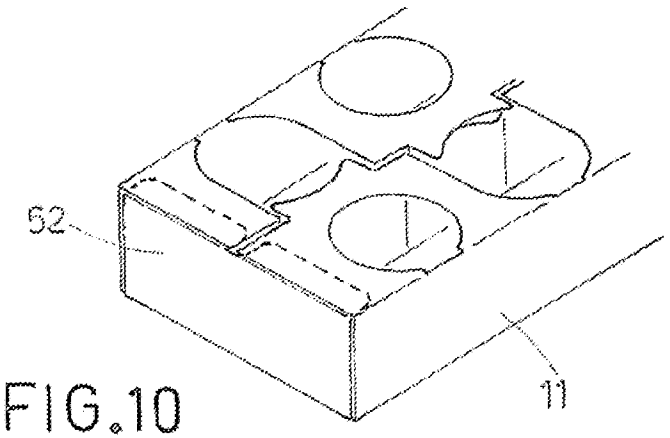
FIG. 10 illustrates a perspective and partial view of a second possible embodiment of the container of cardboard, object of the invention, in the opened-out configuration, ready for receiving the bottles.

In the embodiment of the container (100) illustrated in FIGS. 10 and 11, the stabilizing means (51, 52, 53, 54, 55, 56, 57) are instead constituted by at least a flap (52) in a single body with the base wall (10) at least on a transversal side of the base wall (10), and a pair of wings (53) in a single body with the at least a flap (52) at the side of the flap (52) opposite the side with which it is in a single body with the base wall (10).

The flap (52) is foldable with respect to the base wall (10) and the wings (53) are foldable with respect to the flap (52) such that, with the container (100) in the opened-out configuration (O), the flap (52) can be folded with respect to the base wall (10) in such a way as to near the first lateral wall (11) and the second lateral wall (12), and the wings (53) can be folded with respect to the flap (52) in such a way to be positionable respectively below the first portion (21) of the first tab (200) of the first series of tabs (2), between the first lateral wall (11) and the central portion (22) of the first tab (200), and below the first reinforcing tab (80) such as to maintain the container (100) in the opened-out configuration (O).

Figure 13:
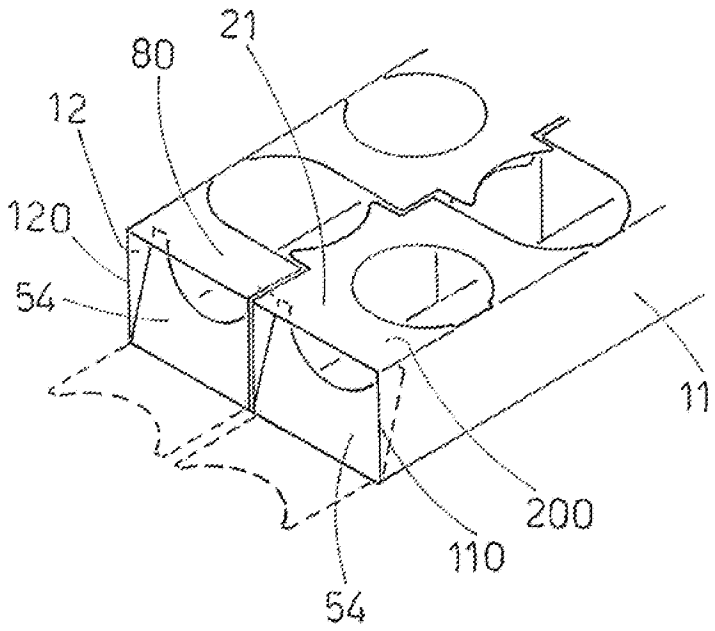
FIG. 13 is a perspective and partial view of a third possible embodiment of the cardboard container, object of the invention, in the opened-out configuration thereof, ready for receiving bottles; in the same figure, a dotted line is used to represent a position assumed by a component of the container in a transition step into the opened-out configuration.

In the embodiment of the container (100) illustrated in FIG. 13, the stabilizing means (51, 52, 53, 54, 55, 56, 57) are constituted by at least a pair of wings (54) in a single body with the base wall (10) at least at a transversal side of the base wall (10).

The wings (54) being foldable with respect to the base wall (10) in such a way that, with the container (100) in the opened-out configuration (O), the wings (54) can be folded with respect to the base wall (10) in such a way as to be positionable each respectively below the first portion (21) of the first tab (200) of the first series of tabs (2), between the first lateral wall (11) and the central portion (22) of the first tab (200), and below the first reinforcing tab (80), such as to maintain the container (100) in the opened-out configuration (O).

Figure 16:
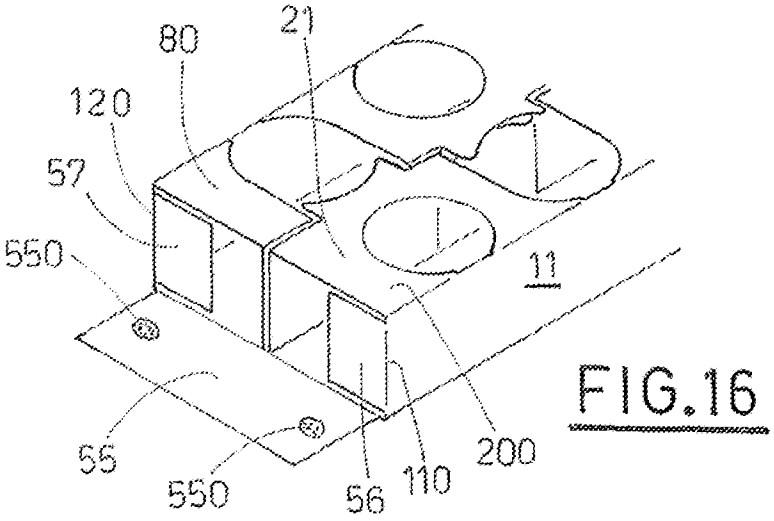
FIG. 16 illustrates, once more in a perspective and partial view, the container of FIG. 15 in which the positions assumed by the components of the container in a transition step to the opened-out configuration are shown.
Figure 15:
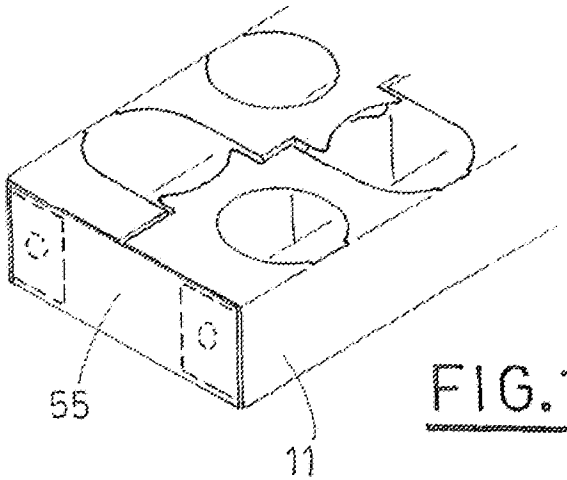
FIG. 15 is a perspective and partial view of a fourth possible embodiment of the cardboard container of the invention in the opened-out configuration thereof, ready for receiving the bottles.

In the embodiment of the container (100) illustrated in FIGS. 15, 16, the stabilizing means (51, 52, 53, 54, 55, 56, 57) are constituted by at least a flap (55), in a single body with the base wall (10) at least at a transversal side of the base wall (10), interested by adhesive means (550), by a first wing (56), in a single body with a transversal edge (110) of the first lateral wall (11), and by a second wing (57) in a single body with a transversal edge (120) of the second lateral wall (12).

The flap (55) is foldable with respect to the base wall (10) and the first wing (56) is foldable with respect to the first lateral wall (11) and the second wing (57) is foldable with respect to the second lateral wall (12) in such a way that, with the container (100) in the opened-out configuration (O), the first wing (56) can be folded such as to be positioned below the first portion (21) of the first tab (200) of the first series of tabs (2), between the first lateral wall (11) and the central portion (22) of the first tab (200), the second wing (57) can be folded such as to be positioned below the first reinforcing tab (80), and the flap (55) can be folded such as to bring the adhesive means (550) to adhere to the first wing (56) and the second wing (57) such as to fix the flap (55) thereto, in order to maintain the container (100) in the opened-out configuration (O).

Figure 9:
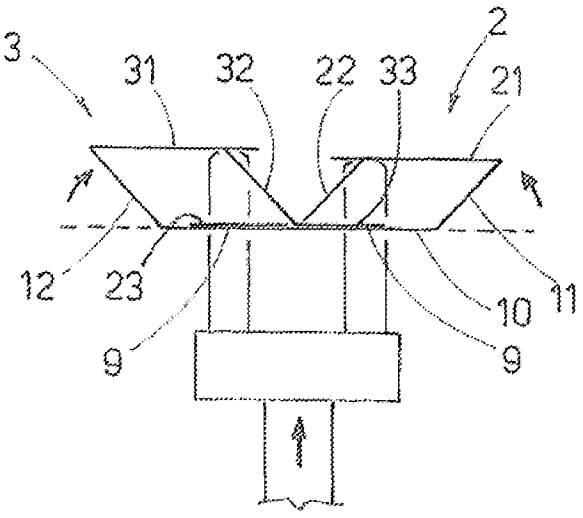
FIG. 9 illustrates a front view of a passage step of the container from the flattened configuration (shown in FIG. 5A) to the opened-out configuration (referred to FIG. 3)

Lastly, the container (100) of the present invention can exhibit a base wall (10) that exhibits through-holes (9) suitable for being interested, with the container (100) in the flattened configuration (I), by the insertion of pushing means (for example small rods as illustrated in FIG. 9) such that the pushing means can act on the first series of tabs (2) and on the second series of tabs (3), facilitating bending thereof into the corner configuration, i.e. facilitating the passage of the container (100) from the flattened configuration (I) to the opened-out configuration (O).

Figure 12:
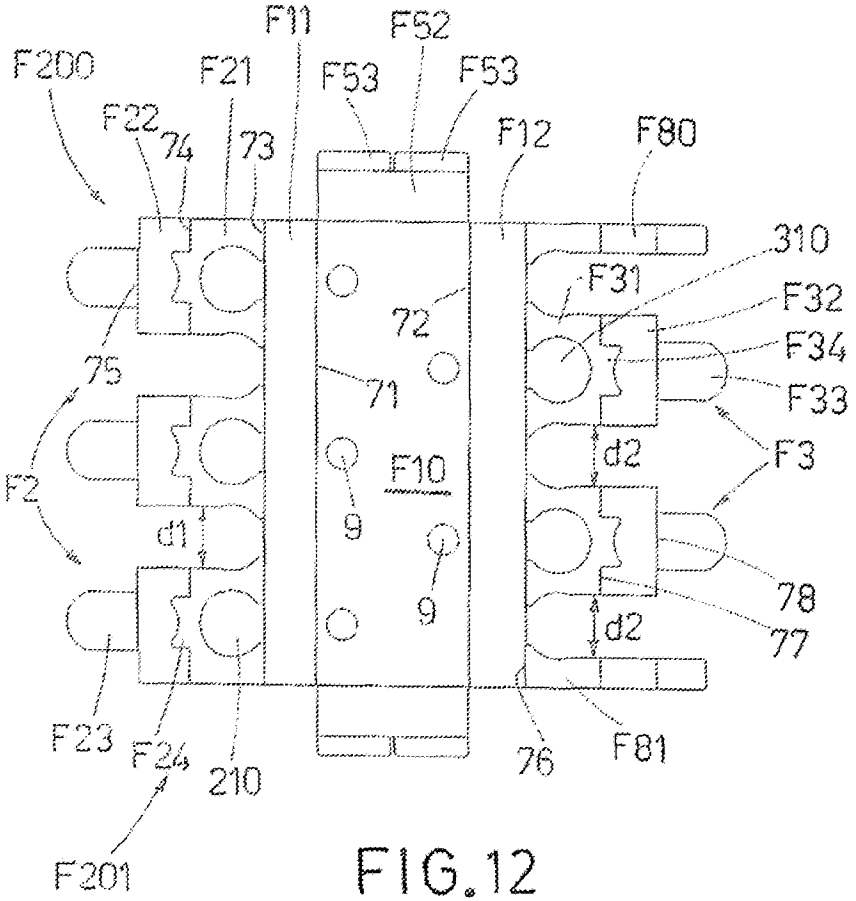
FIG. 12 is a plan view of a second possible embodiment of the blank according to the invention, from which following folding thereof, the cardboard container of FIGS. 10, 11 can be obtained.
Figure 14:
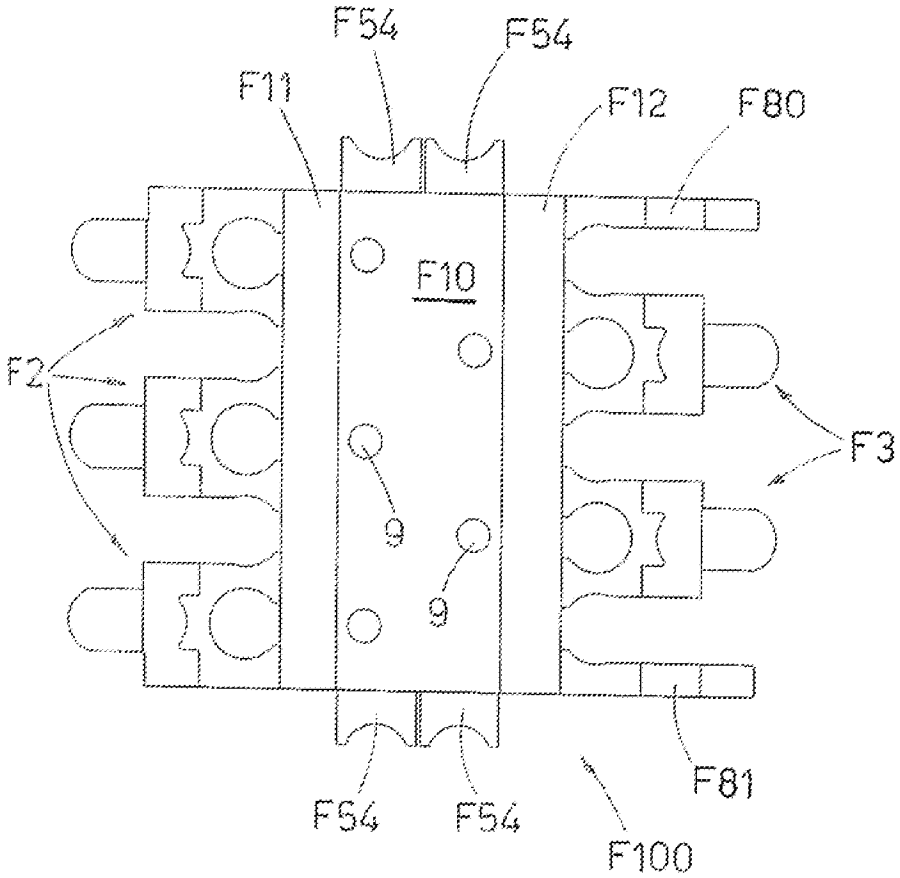
FIG. 14 is a plan view of a third possible embodiment of the blank according to the invention, from which the container of FIG. 13 can be obtained following folding.
Figure 17:
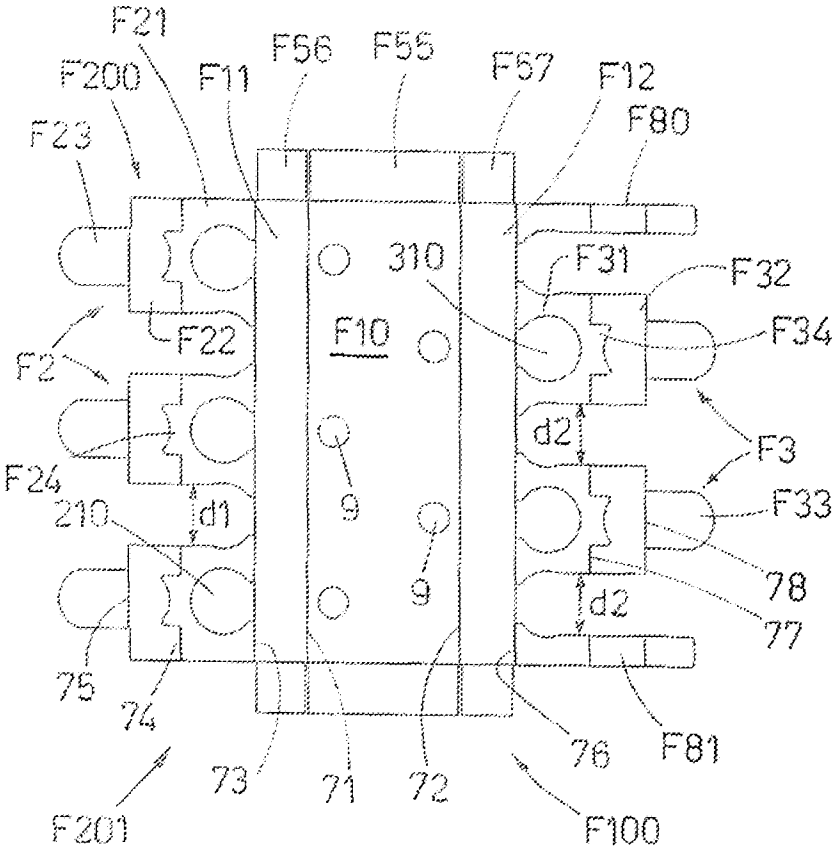
FIG. 17 is a plan view of a fourth possible embodiment of the blank of the invention, from which blank the container of FIGS. 15, 16 can be obtained by appropriate folding.

The cardboard blank (F100), which is usable for obtaining, following the folding thereof, the cardboard container (100) described above, is illustrated in the various possible embodiments, corresponding to the various embodiments of the container described above, respective in FIGS. 5B, 8 (corresponding to the embodiment of the containers of FIGS. 3-7), FIG. 12 (corresponding to the embodiment of the container of FIGS. 10-11), FIG. 14 (corresponding to the embodiment of the container of FIG. 13) and FIG. 17 (corresponding to the embodiment of the container).

The blank (F100) comprises: a central section (F10), a first lateral section (F11) and a second lateral section (F12) arranged at the opposite longitudinal sides of the central section (F10).

The blank (F10) exhibits a first score line (71) between the central section (F10) and the first lateral section (F11) such as to enable folding the first lateral section (F11) with respect to the central section (F10) such that the first lateral section (F11) can be arranged equally on the same plane as the central section (F10), externally of the central section (F10), or in an angled position with respect to the central section (F10).

The blank (F100) also exhibits a second score line (72) between the central section (F10) and the second lateral section (F12), such as to enable folding the second lateral section (F12) with respect to the central section (F10) such that the second lateral section (F12) can be arranged equally both on the same plane as the central section (F10), externally of the central section (F10), and in an angled position with respect to the central section (F10).

The blank (F100) is also provided with a first series of tabs (F2), in a single body with the first lateral section (F11), each tab (F2) exhibiting a first portion (F21) and a second portion (F23), the first portion (F21) exhibiting a through-hole (210) of such dimensions as to enable inserting a bottle (F) and which is connected with the first lateral section (F11), at the opposite side to the side with which the first lateral section (F11) is connected with the central section (F10).

The blank (F100) also exhibits a second series of tabs (F3), in a single body with the second lateral section (F12), each tab (F3) exhibiting a first portion (F31) and a second portion (F33), the first portion (F31) exhibiting a through-hole (310) of such dimensions as to enable inserting a bottle (F) and which is connected with the second lateral section (F12), at the opposite side to the side with which the second lateral section (F12) is connected with the central section (F10). The blank (F100) further exhibits a third score line (73) between the first lateral section (F11) and the first portion (F21) of the tabs of the first series of tabs (F2) such as to enable folding the tabs (F2) with respect to the first lateral section (F11) such that the second portion (F23) of the tabs (F2) can be fixed to the central section (F10), and also a fourth score line (76) between the second lateral section (F12) and the first portion (F31) of the second series of tabs (F3) such as to enable the folding of the tabs (F3) with respect to the second lateral section (F12) such that the second portion (F33) of the tabs (F3) can be fixed to the central section (F10) (see for example FIG. 8 in which a step of folding the blank (F100) is illustrated such as to obtain a container (100) in which the final tab (F2) of the first series of tabs (2) still has to be folded about the score line (73) with respect to the central section (F10) so that the second portion (F23) can be fixed thereto).

The first series of tabs (F2) and the second series of tabs (F3) of the blank (F100) are further bendable such as to be able to assume, with the first lateral section (F11) and the second lateral section (F12) arranged on the same plane as the central section (F10), externally thereof, a flat configuration respectively above the central section (F10) and the first lateral section (F11) and above the central section (F10) and the second lateral section (F12), and further bendable such as to be able to take on, with the first lateral section (F11) and with the second lateral section (F12) corner-folded with respect to the central section (F10), a corner-folded form with the first portion (F21) of the first series of tabs (F21) and with the first portion (F31) of the second series of tabs (F3) arranged in an opposite position to the central section (F10).

These special bending abilities of the tabs end the container (100) obtained from the blank (F100) to take on the flattened configuration (I) and the opened-out configuration (O).

In particular, to this end, each tab of the first series of tabs (F2) comprises a central portion (F22) between the first portion (F21) and the second portion (F23) and each tab (F3) of the second series of tabs (F3) comprises a central portion (F32) between the first portion (F31) and the second portion (F33).

The blank (F100), in relation to this, comprises score lines (74) between the first portion (F21) and the central portion (F22) of the first series of tabs (F2) and score lines (75) between the central portion (F22) and the second portion (F23) of the first series of tabs (F2) such that the central portion (F22) of the tabs (F2) is foldable with respect to the first portion (F21) and with respect to the second portion (F23) such that, with the first lateral section (F11) and the second lateral section (F12) corner-folded with respect to the central section (F10), the central portion (F22) of the first series of tabs (F2) is corner-arranged with respect to the central section (F10).

Correspondingly the blank (F100) further comprises score lines (77) between the first portion (F31) and the central portion (F32) of the second series of tabs (F3) and score lines (78) between the central portion (F32) and the second portion (F33) of the second series of tabs (F3) such that the central portion (F32) of the tabs (F3) is foldable with respect to the first portion (F31) and with respect to the second portion (F33) such that, with the first lateral section (F11) and with the second lateral section (F12) corner-folded with respect to the central section (F10), the central portion (F32) of the second series of tabs (F3) is corner-arranged with respect to the central section (F10).

The blank (F100) is such that the first series of tabs (F2) is arrange staggered with respect to the second series of tabs (F3), the tabs (F2) of the first series of tabs (F2) being distanced from one another in such a way that between them there is a space (d1) having dimensions that are at least equal to the transversal dimensions of a bottle (F) and with the tabs (F3) of the second series of tabs (F3) being distanced from one another such that between them there is a space (d2) having dimensions that are at least equal to the transversal dimensions of a bottle (F).

In particular, the blank (F100) is such that each of the tabs (F2) of the first series of tabs (F2) is provided, between the first portion (F21) and the central portion (F22), with an arched portion (F24) having a profile corresponding to the profile of a part of a bottle (F) such as, with the first lateral section (F11) and with the second lateral section (F12) corner-folded with respect to the central section (F10) and with the tabs (F2) taking on a corner-folded shape, with the central portion (F22) corner-arranged with respect to the central section (F10), to project from the central portion (F22).

Correspondingly, the blank (F100) is also such that each of the tabs (F3) of the second series of tabs (F3) is provided, between the first portion (F31) and the central portion (F32), with an arched portion (F34) of profile corresponding to the profile of a part of a bottle (F) such as, with the first lateral section (F11) and with the second lateral section (F12) corner-folded with respect to the central section (F10) and with the tabs (F3) taking on a corner-folded shape, with the central portion (F32) corner-arranged with the respect to the central section (F10), to be projecting from the central portion (F32).

In more detail, in the illustrated embodiments, the blank (F100) is such that the first series of tabs (F2) is arranged in such a way that a first tab (F200) of the first series of tabs (F2) is contiguous to a transversal edge of the first lateral section (F11) and a last tab (F201) of the first series of tabs (F2) is contiguous to the other transversal edge of the first lateral section (F11) and the tabs (F3) of the second series of tabs (F3) are arranged such as to be staggered with respect to the tabs (F2) of the first series of tabs (F2), with each tab (F3) being arranged opposite the space (d1) present between the tabs (F2) of the first series of tabs (F2). Further, in this case, the blank (F100) is such as to exhibit a first auxiliary tab (F80), on the side of the second lateral section (F12) opposite the side with which the second lateral section (12) is connected to the central section (F10) and situated contiguously to a transversal edge of the second lateral section (F12), and to also exhibit a second auxiliary tab (F81), also on the side of the second lateral section (F12) opposite the side with which the second lateral section (12) is connected to the central section (F10) and situated contiguous to the other transversal edge of the second lateral surface (F12) such that the tabs (F3) of the second series of tabs (F3) are arranged between the first auxiliary tab (F80) and the second auxiliary tab (F81).

The blank (F100) further comprises score lines between the central section (F10) and the first auxiliary tab (F80) and the second auxiliary tab (F81), such that the first auxiliary tab (F80) and the second auxiliary tab (F81) are bendable such as to be fixable to the central portion (F10) and such as to be able to take on, with the first lateral section (F11) and the second lateral section (F12) corner-folded with respect to the central section (F10) and with the tabs (F2) and the tabs (F3) taking on a corner-folded shape, a corner-configuration with respect to the central section (F10).

The first auxiliary tab (F80) exhibits dimensions such that between it and the first tab of the second series of tabs (F3) there is a space (d2) of dimensions corresponding to the space (d2) present between the tabs (F3), and the second auxiliary tab (F81) exhibits dimensions such that between it and the last tab of the second series of tabs (F3) there is a space (d2) of dimensions corresponding to the space (d2) present between the tabs (F3).

Figure 8:
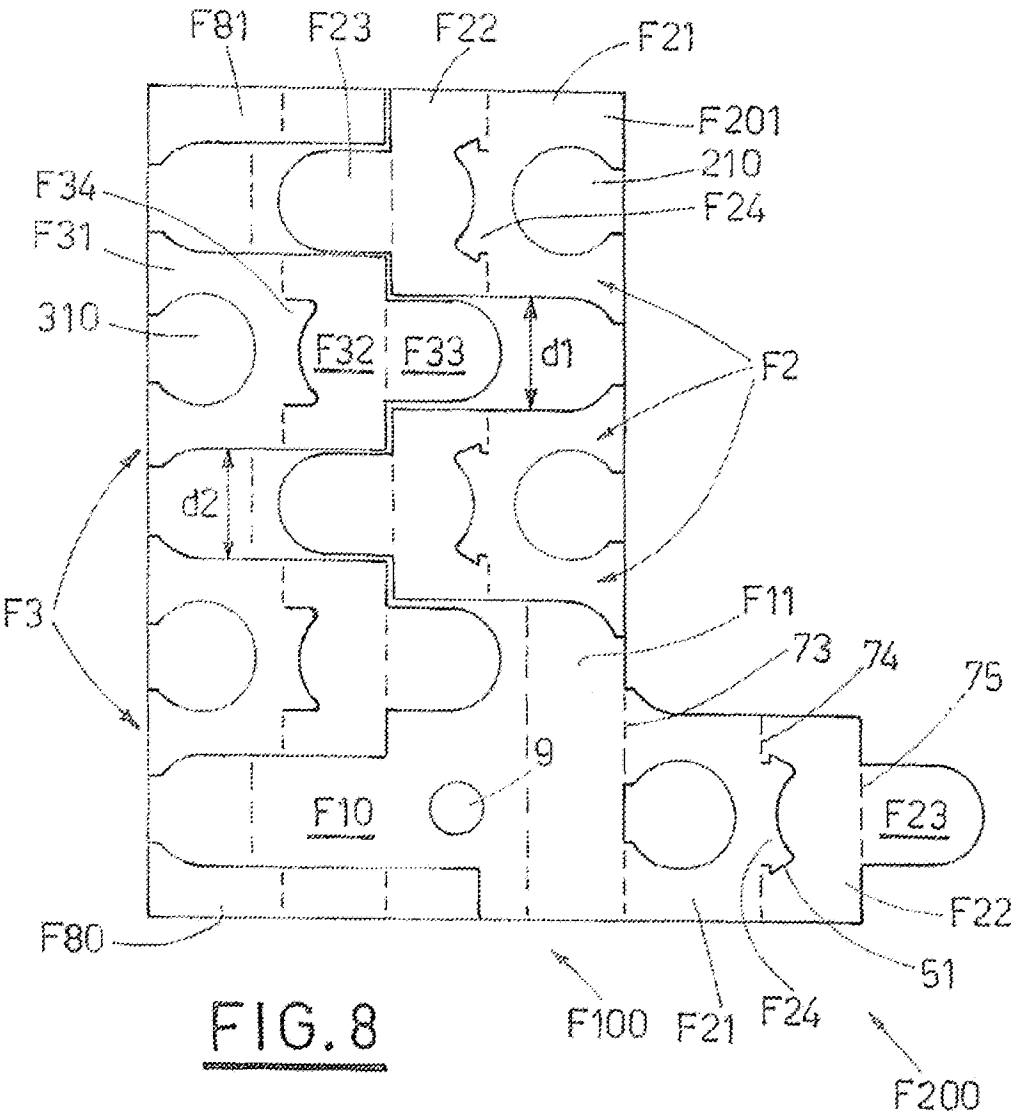
FIG. 8 illustrates a plan view of a second phase of the folding of the blank of FIG. 5B to obtain the container of FIGS. 3-5A.

In an embodiment illustrated in FIGS. 5B, 8, the blank (F100) comprises prongs (51) in a single body with the arched portions (F24) of the first series of tabs (F2), at the lateral ends of the tabs (F24) (the container of FIGS. 3-7 can be obtained from this embodiment of the blank); and/or prongs (not illustrated) in a single body with the arched portions (F34) of the second series of tabs (F3) at the lateral ends of the arched portions (F34).

In a further possible embodiment, illustrated in FIG. 12, the blank (F100) can comprise a flap (F52) at the transversal sides of the central section (F10), and a pair of wings (53) in a single body with the flap (F52), a score line between the flap (F52) and the central section (F10) in such a way that the flap (F52) is foldable with respect to the central section (F10) in such a way as to take on an angled configuration with respect thereto, and respective score lines between the flap (F52) and the pair of wings (F53) in such a way that the wings (F53) are foldable with respect to the flap (F52) such as to take on a corner-angled configuration with respect thereto (the container of FIGS. 10-11 can be obtained from this embodiment of the blank).

In a further possible embodiment, illustrated in FIG. 14, the blank (F100) includes a pair of wings (F54) at the transversal sides of the central section (F10) and the score lines between the wings (F54) and the central section (F10) such that the wings (F54) are foldable with respect to the central section (F10) such as to take on an angled configuration with respect thereto (the container of FIG. 13 is obtainable from this embodiment).

FIG. 17 illustrates a further possible embodiment of the blank (F100) which includes a flap (F55) at the transversal sides of the central section (F10), a first wing (F56) at the transversal edges of the first lateral section (F11) and a second wing (F57) at the transversal edges of the second lateral section (F12).

In this case the blank (F100) also exhibits a score line between the first tab (F56) and the first lateral section (F11), such that the first wing (F56) is foldable with respect to the first lateral section (F11) such as to take on an angled configuration with respect thereto, a score line between the second wing (F57) and the second lateral section (F12), such that the second wing (F57) is foldable with respect to the second lateral section (F12) in such a way as to take on an angled configuration with respect thereto, and a score line between the flap (F55) and the central section (F10) in such a way that the flap (F55) is foldable with respect to the central section (F10) so as to take on an angled configuration with respect thereto (the container of FIGS. 16-17 can be obtained from this embodiment of the blank).

In the various embodiments, the blank (F100) can be provided with through-holes (9) in the central section (F10).

The above has been described by way of non-limiting example, and any constructional variants are understood to fall within the scope of the following claims.

The invention claimed is:

1. A cardboard container for bottles comprising a base wall, a first lateral wall and a second lateral wall, in a single body with the base wall at two opposite longitudinal sides of the base wall, the first lateral wall and the second lateral wall being foldable with respect to the base wall, wherein the cardboard container comprises:

a first series of tabs, each tab exhibiting a first portion and a second portion, the first portion exhibiting a through-hole having dimensions such as to enable inserting a bottle and which is connected in a single body with the first lateral wall, at the opposite side to the side with which the first lateral wall is in a single body with the base wall, and with the second portion that is fixed to the base wall, and a second series of tabs, each tab exhibiting a first portion and a second portion, with the first portion exhibiting a through-hole having dimensions such as to enable inserting the bottle and which is connected in a single body with the second lateral wall, at the opposite side to the side with which the second lateral wall is in a single body with the base wall, and with the second portion fixed to the base wall, and wherein the first lateral wall and the second lateral wall are foldable with respect to the base wall in such a way as to reciprocally distance one from the other up to being arranged on a plane containing the base wall, externally of the two opposite longitudinal sides of the base wall, and the tabs of the first series of tabs and the tabs of the second series of tabs, when the first lateral wall and the second lateral wall are folded with respect to the base wall in such a way as to reciprocally distance from one another up to being arranged on a plane containing the base wall, externally of the two opposite longitudinal sides of the base wall, are contemporaneously bendable both with respect to the base wall and, respectively, with respect to the first lateral wall and the second lateral wall in such a way that the tabs of the first series of tabs can take on a flat configuration above the base wall and the first lateral wall and the tabs of the second series of tabs can take on a flat configuration above the base wall and the second lateral wall in such a way that the container takes on a flattened configuration, and wherein the first lateral wall and the second lateral wall are further bendable foldable with respect to the base wall in such a way as to be able to be arranged opposite one another and in such a way as to form an angle with respect to the base wall, and the tabs of the first series of tabs and the tabs of the second series of tabs, when the first lateral wall and the second lateral wall are folded with respect to the base wall in such a way as to be arranged opposite and at an angle with respect to the base wall, are further contemporaneously respectively bendable in such a way as to take on a corner-folded shape and in such a way that the first portion of the first series of tabs and the first portion of the second series of tabs are arranged opposite the base wall, such that the container takes on an opened-out configuration, and wherein the container is provided with stabilizing means usable for maintaining the first series of tabs and the second series of tabs corner-folded, with the first portion, provided with the through-hole, of the first series of tabs and with the first portion, provided with the through-hole, of the second series of tabs, opposite the base wall such that the container maintains the opened-out configuration in order to receive the bottles in said through-holes;

wherein the tabs of the first series of tabs are connected, with the relative first portions, in a single body with the first lateral wall in such a way that the first portions are distanced from one another such that there is a first space between them having dimensions that are at least the same as the transversal dimensions of the bottle, and the tabs of the second series of tabs are connected, with the relative first portions, in a single body with the second lateral wall in such a way that the first portions are distanced from one another in such a way that between them there is a second space, of dimensions that are at least equal to the transversal dimensions of the bottle, and such as to be in a staggered position with respect to the first portions of the first series of tabs in such a way that, with the container in the opened-out configuration and with the first portions of the first series of tabs and with the first portions of the second series of tabs that are opposite the base wall, the first portions of the first series of tabs are in front of the second space present between the second portions of the second series of tabs in such a way as to delimit first seatings for inserting bottles, and the first portions of the second series of tabs are in front of the first space present between the first portions of the first series of tabs such as to delimit second seatings for inserting the bottles;

wherein each tab of the first series of tabs comprises a central portion, between the first portion connected in a single body to the first lateral wall and the second portion fixed to the base wall, which is foldable both with respect to the first portion and the second portion and exhibits dimensions such that, with the container in the opened-out configuration, the central portion is corner-arranged with respect to the base wall and facing a respective seating of the first seatings, between the first portions of the second series of tabs, such as to constitute a lateral containing wall for the bottle, and each tab of the second series of tabs comprises a central portion, between the first portion connected in a single body to the second lateral wall and the second portion fixed to the base wall, which is foldable both with respect to the first portion and the second portion and exhibits dimensions that are such that, with the container in the opened-out configuration, the central portion is corner-arranged with respect to the base wall and facing a seating of the second seatings, between the first portions of the first series of tabs, such as to constitute a lateral containing wall for the bottle;

wherein each of the tabs of the first series of tabs exhibits, between the relative first portion and central portion, a first appendage which, with the container in the opened-out configuration, is projecting from the central portion in such a way as to interest a seating of the first seatings, between the first portions of the second series of tabs, and which exhibits an arched profile having a shape corresponding to the profile of a part of the bottle, in such a way as to constitute an abutment for the bottle, and each of the tabs of the second series of tabs exhibits, between the relative first portion and central portion, a second appendage which, with the container in the opened-out configuration, projects from the central portion, in such a way as to interest a seating of the second seatings, between the first portions of the first series of tabs, and which exhibits an arched profile having a shape corresponding to the profile of a part of the bottle, in such a way as to constitute an abutment for the bottle.

2. The container of claim 1, wherein the central portions of the first series of tabs and the central portions of the second series of tabs exhibit respective transversal dimensions such that, with the container in the opened-out configuration, they are reciprocally arranged partially opposite and facing with a part of a surface thereof.

3. The container of claim 2, wherein the central portions of the first series of tabs and the central portions of the second series of tabs exhibit respective transversal dimensions such that, with the container in the opened-out configuration, they are reciprocally arranged partially opposite and facing one another, and in contact with one another, with a part of the surface thereof.

4. The container of claim 1, wherein the tabs of the first series of tabs are arranged such that a first tab of the first series of tabs is situated contiguously to a transversal edge of the first lateral wall and a last tab of the first series of tabs is situated contiguous to another transversal edge of the first lateral wall and wherein the tabs of the second series of tabs are arranged staggered with respect to the tabs of the first series of tabs so as to be located between the first tab and the last tab thereof, and further comprising a first reinforcing tab and a second reinforcing tab in a single body with the second lateral wall at the opposite side with which the second lateral wall is in a single body with the base wall, and fixed to the base wall, the first reinforcing tab being situated contiguous with a transversal edge of the second lateral wall and the second reinforcing tab contiguous to another transversal edge of the second lateral wall, between which first reinforcing tab and second reinforcing tab the tabs of the second series of tabs are situated, the first reinforcing tab and the second reinforcing tab being bendable with respect to the base wall and with respect to the second lateral wall in such a way as to be arranged, with the container in the flattened configuration, in a flat configuration above the base wall and the second lateral wall, and such as to be arranged with corner-configuration, with the container in the opened-out configuration.

5. The container of claim 4, wherein the first reinforcing tab is positioned in such a way as to exhibit dimensions that, between the first reinforcing tab and a first tab of the second series of tabs, there is a third space having dimensions that correspond to the second space between the tabs such that, with the container in the opened-out configuration, between the first reinforcing tab and the first tab of the second series of tabs a seating is defined for insertion of a bottle, and the second reinforcing tab is positioned so as to exhibit dimensions that, between the second reinforcing tab and a last tab of the second series of tabs there is a fourth space of dimensions corresponding to the second space between the tabs such that, with the container in the opened-out configuration, between the second reinforcing tab and the last tab of the second series of tabs a seating is defined for inserting a bottle.

6. The container of claim 4, wherein the stabilizing means are constituted by prongs associated to the first series of tabs, in a position such that, with the container in the opened-out configuration and with the first series of tabs and the second series of tabs corner-folded, the prongs are adapted to abut and hook with edges of the central portion of the second series of tabs and/or by prongs associated to the second series of tabs in a position such that, with the container in the opened-out configuration and with the first series of tabs and with the second series of tabs corner-folded, the prongs are adapted to abut and hook the edges of the central portion of the first series of tabs so as to maintain the container in the opened-out configuration.

7. The container of claim 4, wherein the stabilizing means are constituted by prongs in a single body with the first appendages of the first series of tabs at the lateral ends of the first appendages, the prongs being of a shape and dimensions such that, with the container in the opened-out configuration and with the first series of tabs and the second series of tabs corner-folded, and with the first appendages of the first series of tabs intersecting the first seating between the first portions of the second series of tabs, the prongs are adapted to abut and hook the edges of the central portion of the second series of tabs and/or by prongs in a single body with the second appendages of the second series of tabs at the lateral ends of the second appendages, the prongs being of a shape and dimensions so as to, with the container in the opened-out configuration and with the first series of tabs and with the second series of tabs corner-folded, and with the second appendages of the second series of tabs which interest the second seating between the first portions of the first series of tabs, abut and connect hook with the edges of the central portion of the first series of tabs, so as to maintain the container in the opened-out configuration.

8. The container of claim 4, wherein the stabilizing means are constituted by at least one flap in a single body with the base wall at least on a transversal side of the base wall, and a pair of tabs-wings in a single body with the at least one flap at the side of the flap opposite the side with which it is in a single body with the base wall, the flap being foldable with respect to the base wall and with the tabs-wings being foldable with respect to the flap such that, with the container in the opened-out configuration, the flap can be folded with respect to the base wall in such a way that, near the first lateral wall and the second lateral wall, the wings can be folded with respect to the flap so as to be positioned respectively below the first portion of the first tab of the first series of tabs, between the first lateral wall and the central portion of the first tab, and below the first reinforcing tab so as to maintain the container in the opened-out configuration.

9. The container of claim 4, wherein the stabilizing means are constituted by at least a pair of wings in a single body with the base wall at least at a transversal side of the base wall, the wings being foldable with respect to the base wall in such a way that, with the container in the opened-out configuration, the wings can be folded with respect to the base wall in such a way as to be positionable each respectively below the first portion of the first tab of the first series of tabs, between the first lateral wall and the central portion of the first tab, and below the first reinforcing tab, such as to maintain the container in the opened-out configuration.

10. The container of claim 4, wherein the stabilizing means are constituted by at least one flap, in a single body with the base wall at least at a transversal side of the base wall, interested by an adhesive, by a first wing, in a single body with a transversal edge of the first lateral wall, and by a second wing in a single body with a transversal edge of the second lateral wall, with the flap being foldable with respect to the base wall and the first wing being foldable with respect to the first lateral wall and the second wing which is foldable with respect to the second lateral wall in such a way that, with the container in the opened-out configuration, the first wing can be folded such as to be positioned below the first portion of the first tab of the first series of tabs, between the first lateral wall and the central portion of the first tab, the second tab-wing can be folded such as to be positioned below the first reinforcing tab, and the flap can be folded such as to cause the adhesive to adhere to the first wing and the second tab-wing so as to fix the flap thereto, in order to maintain the container in the opened-out configuration.

11. The container of claim 1, wherein the base wall exhibits through-holes suitable for being interested, with the container in the flattened configuration, by the insertion of pushing means such that the pushing means can act on the first series of tabs and on the second series of tabs, facilitating folding bending thereof into the corner configuration.

12. A cardboard blank, usable for obtaining a cardboard container for vials bottles comprising:

a central section, a first lateral section and a second lateral section arranged at opposite longitudinal sides of the central section, a first score line located between the central section and the first lateral section to enable folding the first lateral section with respect to the central section so that the first lateral section can be arranged equally on a same plane as the central section, externally of the central section, and in an angled position with respect to the central section, a second score line located between the central section and the second lateral section to enable folding the second lateral section with respect to the central section so that the second lateral section can be arranged equally both on the same plane as the central section, externally of the central section, and in an angled position with respect to the central section, and further comprising a first series of tabs, each tab exhibiting a first portion and a second portion, the first portion exhibiting a through-hole of such dimensions as to enable inserting a bottle and which is connected with the first lateral section, at the opposite side to the side with which the first lateral section is connected with the central section, a third score line located between the first lateral section and the first portion of the tabs of the first series of tabs to enable folding the tabs with respect to the first lateral section so that the second portion of the tabs can be fixed to the central section, and further comprising a second series of tabs, each tab exhibiting a first portion and a second portion, the first portion exhibiting a through-hole of such dimensions as to enable inserting the bottle and which is connected with the second lateral section, at the opposite side to the side with which the second lateral section is connected with the central section, and a fourth score line located between the second lateral section and the first portion of the second series of tabs to enable the folding of the tabs with respect to the second lateral section so that the second portion of the tabs can be fixed to the central section;

wherein the first series of tabs and the second series of tabs are foldable bendable so as to assume, with the first lateral section and the second lateral section arranged on the same plane as the central section, externally thereto, a flat configuration respectively above the central section and the first lateral section and above the central section and the second lateral section, and further being foldable bendable so as to take on, with the first lateral section and with the second lateral section corner-folded with respect to the central section, a corner-folded form with the first portion of the first series of tabs and with the first portion of the second series of tabs arranged in an opposite position to the central section;

wherein each tab of the first series of tabs has a central portion between the first portion and the second portion and each tab of the second series of tabs has a central portion between the first portion and the second portion, and wherein score lines are located between the first portion and the central portion of the first series of tabs and with score lines located between the central portion and the second portion of the first series of tabs such that the central portion of the tabs is foldable with respect to the first portion and with respect to the second portion such that, with the first lateral section and the second lateral section corner-folded with respect to the central section, the central portion of the first series of tabs is corner-arranged with respect to the central section and wherein score lines are located between the first portion and the central portion of the second series of tabs with score lines located between the central portion and the second portion of the second series of tabs such that the central portion of the tabs is foldable with respect to the first portion and with respect to the second portion such that, with the first lateral section and with the second lateral section corner-folded with respect to the central section, the central portion of the second series of tabs is corner-arranged with respect to the central section;

wherein the first series of tabs is arrange staggered with respect to the second series of tabs, the tabs of the first series of tabs being distanced from one another in such a way that between them there is a first space having dimensions that are at least equal to the transversal dimensions of the bottle and with the tabs of the second series of tabs being distanced from one another such that between them there is a second space having dimensions that are at least equal to the transversal dimensions of the bottle; and, wherein each of the tabs of the first series of tabs is provided, between the first portion and the central portion, with an arched portion having a profile corresponding to the profile of a part of the bottle such as, with the first lateral section and with the second lateral section corner-folded with respect to the central section and with the tabs taking on a corner-folded shape, with the central portion corner-arranged with respect to the central section, to be projecting from the central portion, and wherein each of the tabs of the second series of tabs is provided, between the first portion and the central portion, with an arched portion of a profile corresponding to the profile of a part of the bottle such as, with the first lateral section and with the second lateral section corner-folded with respect to the central section and with the tabs taking on a corner-folded shape, with the central portion corner-arranged with the respect to the central section, to be projecting from the central portion.

13. The blank of claim 12, wherein the first series of tabs is arranged such that a first tab of the first series of tabs is contiguous to a transversal edge of the first lateral section and a last tab of the first series of tabs is contiguous to an other transversal edge of the first lateral section and the tabs of the second series of tabs are arranged such as to be staggered with respect to the tabs of the first series of tabs, with each tab being arranged opposite the first space present between the tabs of the first series of tabs and further comprising a first auxiliary tab, on the side of the second lateral section opposite the side with which the second lateral section is connected to the central section and situated contiguously to a transversal edge of the second lateral section, and a second auxiliary tab, also on the side of the second lateral section opposite the side with which the second lateral section is connected to the central section and situated contiguous to the other transversal edge of the second lateral surface such that the tabs of the second series of tabs are arranged between the first auxiliary tab and the second auxiliary reinforcing tab, with the first auxiliary tab and the second auxiliary tab being bendable such as to be fixable to the central portion and such as to be able to take on, with the first lateral section and the second lateral section corner-folded with respect to the central section and with the tabs and the tabs taking on a corner-folded shape, a corner-configuration with respect to the central section.

14. The blank of claim 13, wherein the first auxiliary tab exhibits dimensions such that between the first auxiliary tab and the first tab of the second series of tabs there is a space of dimensions corresponding to the second space present between the tabs, and the second auxiliary tab exhibits dimensions such that between the second auxiliary tab and the last tab of the second series of tabs there is a space of dimensions corresponding to the second space present between the tabs.

15. The blank of claim 12, further comprising prongs in a single body with the arched portions of the first series of tabs, at the lateral ends of the arched portions and/or prongs in a single body with the arched portions of the second series of tabs at the lateral ends of the arched portions.

16. The blank of claim 12, further comprising a flap at the transversal sides of the central section and a pair of tabs-wings in a single body with the flap, a score line located between the flap and the central section in such a way that the flap is foldable with respect to the central section so as to take on a corner configuration with respect thereto, and respective score lines located between the flap and the pair of wings such that the wings are foldable with respect to the flap so as to take on a corner configuration with respect thereto.

17. The blank of claim 12, further comprising a pair of wings at the transversal sides of the central section and score lines located between the tabs-wings and the central section such that the wings are foldable with respect to the central section so as to take on a corner configuration with respect thereto.

18. The blank of claim 12, further comprising a flap at the transversal sides of the central section, a first wing at the transversal sides of the first lateral section and a second wing at the transversal sides of the second lateral section, a score line located between the first wing and the first lateral section such that the first wing is foldable with respect to the first lateral section such as to take on a corner configuration with respect thereto, a score line between the second tab-wing and the second lateral section such that the second wing is foldable with respect to the second lateral section such as to take on a corner configuration with respect thereto, and a score line located between the flap and the central section in such a way that the flap is foldable with respect to the central section such as to take on a corner configuration with respect thereto.

19. The blank of claim 12, wherein the central section exhibits through-holes.

* * * * *